US007373790B2

(12) United States Patent
Clare et al.

(10) Patent No.: US 7,373,790 B2
(45) **Date of Patent: *May 20, 2008**

(54) NITROGEN REJECTION METHOD AND APPARATUS

(75) Inventors: Stephen R. Clare, Bognor Regis (GB); John D. Oakey, Godalming (GB)

(73) Assignee: The BOC Group, plc (GB)

( * ) Notice: Subject to any disclaimer, the term of this patent is extended or adjusted under 35 U.S.C. 154(b) by 0 days.

This patent is subject to a terminal disclaimer.

(21) Appl. No.: 11/453,206

(22) Filed: Jun. 14, 2006

(65) Prior Publication Data

US 2006/0230783 A1 Oct. 19, 2006

Related U.S. Application Data

(63) Continuation of application No. 10/653,816, filed on Sep. 3, 2003, now Pat. No. 7,127,915.

(30) Foreign Application Priority Data

Sep. 6, 2002 (GB) ..... 0220791.8

(51) Int. Cl.
*F25J 3/00* (2006.01)

(52) U.S. Cl. ..... 62/621; 62/927; 62/628

(58) Field of Classification Search ..... 62/620, 62/621, 630, 927, 628

See application file for complete search history.

(56) References Cited

U.S. PATENT DOCUMENTS

| | | | | |
|---|---|---|---|---|
| 2,823,523 | A * | 2/1958 | Eakin et al. | 62/622 |
| 3,559,417 | A * | 2/1971 | Hoffman | 62/622 |
| 4,451,275 | A * | 5/1984 | Vines et al. | 62/622 |
| 4,455,158 | A * | 6/1984 | Vines et al. | 62/622 |
| 5,421,165 | A * | 6/1995 | Paradowski et al. | 62/621 |
| 6,129,511 | A * | 10/2000 | Salvage et al. | 415/150 |
| 6,463,748 | B1 * | 10/2002 | Benedict et al. | 62/228.1 |
| 6,584,803 | B2 * | 7/2003 | Oakey | 62/621 |
| 7,127,915 | B2 * | 10/2006 | Clare et al. | 62/621 |

* cited by examiner

*Primary Examiner*—William C Doerrler
(74) *Attorney, Agent, or Firm*—Philip H. Von Neida

(57) ABSTRACT

Nitrogen is rejected from a pressurized feed gas stream comprising methane and nitrogen by cooling the feed gas stream in a main heat exchanger and rectifying the cooled feed gas stream in a double rectification column comprising a higher pressure rectification column, a lower pressure rectification column, and a condenser-reboiler placing the higher pressure column in heat exchange relationship with the lower pressure column. A pump withdraws a methane product stream from the column. The methane product stream is pressurized by the pump and is vaporized in the main heat exchanger. The pressurized feed gas stream is expanded with the performance of external work in an expansion turbine 6 upstream of the main heat exchanger.

10 Claims, 3 Drawing Sheets

NITROGEN REJECTION METHOD AND APPARATUS

CROSS REFERENCE TO RELATED APPLICATIONS

This application is a continuation of U.S. patent Ser. No. 10/653,816, entitled "Nitrogen Rejection Method and Apparatus", filed on Sep. 3, 2003 now U.S. Pat. No. 7,127,915; which claims priority from United Kingdom Patent Application No. GB0220791.8 filed Sep. 6, 2002, herein incorporated by reference.

BACKGROUND OF INVENTION

This invention relates to a method and apparatus for rejecting nitrogen from a feed gas stream comprising methane and nitrogen so as to form a methane product.

It is known to extract natural gas from underground reservoirs. The natural gas often contains nitrogen. The nitrogen may be in part or totally derived from nitrogen which has been injected into the reservoir as part of an enhanced oil recovery (EOR) or enhanced gas recovery (EGR) operation. A feature of such operations is that the concentration of nitrogen in the natural gas tends to increase with the passage of time from about 5% by volume to about 60% by volume.

U.S. Pat. No. 4,415,345 discloses a process for rejecting the nitrogen from the methane in a double rectification column operating at cryogenic temperatures. A double rectification column comprises a higher pressure rectification column, a lower pressure rectification column, and a condenser-reboiler placing the top of the higher pressure rectification column in indirect heat exchange with a region, usually the bottom, of the lower pressure rectification column. In the process according to U.S. Pat. No. 4,415,345 a stream of a mixture of nitrogen and methane is cooled at elevated pressure to a temperature suitable for its separation by rectification. A part of the feed gas is liquefied. The resulting gas mixture is separated by rectification. In one embodiment described in U.S. Pat. No. 4,415,345 a double rectification column is employed to carry out the separation. A liquid methane product is withdrawn from the bottom of the lower pressure rectification and is raised in pressure by a pump.

The methane product is typically required at a similar pressure to that at which the natural gas is supplied, for example, typically in the order of 40 bar. With relatively high methane feed purity in the order of 95% it is possible to pump the liquid methane product to about 25 bar upstream of its vaporisation which is effected by indirect heat exchange with the incoming feed gas. The vaporised product methane may be raised further in pressure by compression.

As the mole fraction of methane in the feed gas decays and the mole fraction of nitrogen in it rises, efficient heat exchange between the feed gas stream and the product methane stream can be maintained only at lower product stream pressures. For example, if the purity of the feed gas falls to 40% methane, the product methane stream needs to be vaporised at a pressure of about 9 bar. Difficulties arise in providing a compressor or series of compressors that is able to operate efficiently when its inlet pressure varies within such a wide range of pressures.

It is an aim of the present invention to provide a method and apparatus which ameliorates such difficulties.

SUMMARY OF INVENTION

According to the present invention there is provided a method of rejecting nitrogen from a pressurised feed gas stream comprising methane and nitrogen so as to form a methane product, comprising cooling the feed gas stream in a main heat exchanger, rectifying the cooled feed gas stream in a double rectification column comprising a higher pressure rectification column, a lower pressure rectification column, and a condenser-reboiler placing the higher pressure rectification column in heat exchange relationship with the lower pressure rectification column, withdrawing a product methane stream in liquid state from the lower pressure rectification column, raising the pressure of the liquid product methane stream, and vaporising the liquid product methane stream, at least part of the vaporisation being performed in the main heat exchanger, wherein over a range of feed gas stream pressures the pressurised feed gas stream is expanded with the performance of external work upstream of the main heat exchanger.

The invention also provides apparatus for rejecting nitrogen from a pressurised feed gas stream comprising methane and nitrogen so as to form a methane product, comprising a main heat exchanger for cooling the feed gas stream, a double rectification column for rectifying the feed gas stream comprising a higher pressure rectification column, a lower pressure rectification column, and a condenser-reboiler placing the higher pressure rectification column in heat exchange relationship with the lower pressure rectification column, and a liquid pump for withdrawing and pressurising a stream of product methane in liquid state from the lower pressure rectification column, the liquid pump having an outlet communicating with vaporising passages in the main heat exchanger, wherein the apparatus additionally includes upstream of the main heat exchanger an expansion turbine operable over a range of feed gas pressures to expand the feed gas with the performance of external work.

The method and apparatus according to the invention are able to be operated, if desired, at a constant liquid pump outlet pressure. This facilitates operation of a downstream compressor or compressors. Indeed, if the product is required at 40 bar and the outlet pressure of the liquid pump was set throughout the operating life of an apparatus according to the invention the reduction in product flow as a result of increasing nitrogen concentration in the natural gas may be catered for by a plural stage integrally geared product compressor fitted with adjustable inlet guide vanes and adjustable diffuser guide vanes. The external work performed by the feed expansion turbine is typically the generation of electrical power.

In a preferred method according to the invention the operating pressure of the lower pressure rectification column is periodically increased in response to increases in the mole fraction of nitrogen in the pressurised feed gas stream. Accordingly, there is preferably a back pressure regulating valve associated with the lower pressure rectification column which is operable to increase the pressure in the lower pressure rectification column. An advantage of this arrangement is that at higher operating pressures of the lower pressure rectification column a stream of gas withdrawn from the lower pressure rectification column can be expanded with the performance of external work. A second expansion turbine may be provided for this purpose. The expansion of the gas from the lower pressure rectification column may be performed downstream of the passage of such gas through the main heat exchanger and may be employed to generate electrical power. Alternatively, the expansion in the second turbine of the gas stream from the lower pressure rectification column may be performed at cryogenic temperatures and may be employed to generate additional refrigeration for the method. For example, the second expansion turbine may be employed to provide refrigeration for a subcooler in which liquid streams flowing from the higher pressure rectification column to the lower pressure rectification column are subcooled. It is desirable to provide a first heater upstream of the first expansion turbine so as to preheat the feed gas stream. If the second turbine is positioned downstream of the main heat exchanger, there is preferably a second preheater intermediate of the main heat exchanger and the second turbine so as to preheat the gas stream to be expanded therein.

The method and apparatus according to the invention will now be described by way of example with reference to the accompanying drawings, in which:

The drawings are not to scale.

DETAILED DESCRIPTION OF THE INVENTION

A stream of natural gas or gaseous nitrogen-methane mixture is recovered by known means not forming part of this invention from an underground oil or gas reservoir. The stream is typically recovered at a pressure in the order of 40 bar and may initially contain from 5 to 10% by volume of nitrogen. The stream may be subjected to preliminary treatment (not shown) in order to remove any hydrogen sulphide or other sulphur-containing impurity therefrom. Such purification of natural gas is well known in the art and need not be referred to in further detail herein. After removal of any such hydrogen sulphide impurity, the elevated pressure methane-nitrogen stream still typically contains water vapour impurity. The water vapour is removed by passage through a purification unit 2. The purification unit 2 preferably comprises a plurality of adsorption vessels containing adsorbent able selectively to adsorb water vapour from the feed gas stream. Such purification units typically operate on a pressure swing adsorption or a temperature swing adsorption cycle, the latter generally being preferred. If the feed gas stream also contains carbon dioxide impurity, the purification unit 2 can additionally contain an adsorbent selective for carbon dioxide so as to effect the carbon dioxide removal.

Figure 1:
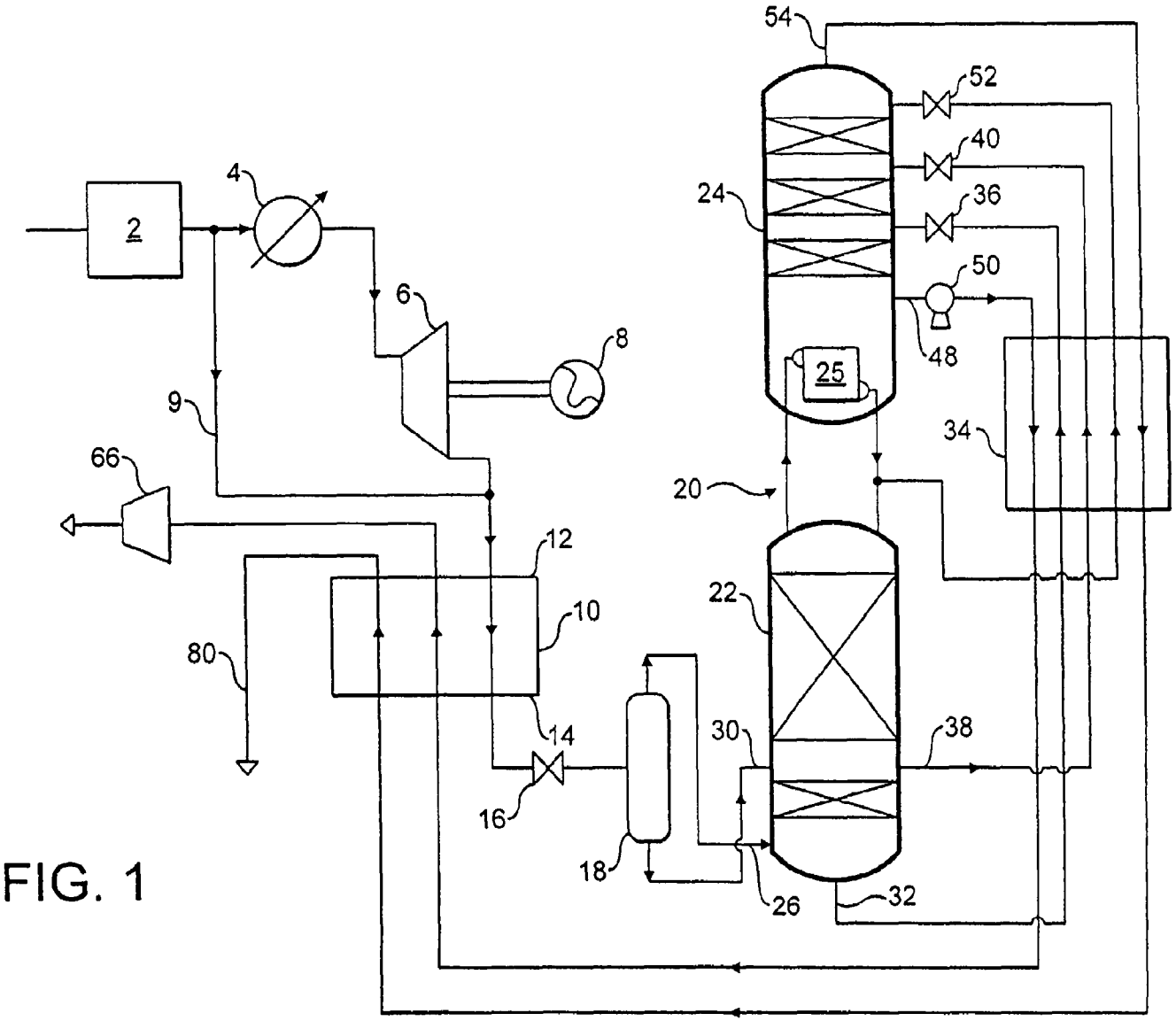
FIG. 1 is a schematic flow diagram of a first nitrogen rejection plant according to the invention.

The resulting purified feed gas stream still consisting essentially of nitrogen and methane and still at a pressure of approximately 40 bar is passed through a heat exchanger 4 and is heated to a temperature in the range of 200° C. to 600° C. The heating is preferably effected by indirect heat exchange in the heat exchanger 4 with a waste gas stream or a superheated stream of steam. The resulting heated feed gas stream flows from the heat exchanger 4 to an expansion turbine 6 in which it is expanded with the performance of external work. For example, as shown in FIG. 1, the expansion turbine 6 may be employed to drive an alternator 8 so as to generate electrical power.

As will be described herein below, the operator of the plant shown in FIG. 1 may choose to pass all the feed gas through the heat exchanger 4 and the expansion turbine 6 or may choose to send the feed gas to a bypass line 9 which bypasses these two units. In either case, the feed gas passes at approximately ambient temperature into a main heat exchanger 10 and flows from its warm end 12 to its cold end 14. The main heat exchanger 10 comprises a plurality of heat exchange blocks preferably joined together to form a single unit. Downstream of the main heat exchanger 10, the feed gas stream is expanded through a throttling valve 16 into a phase separator 18, this throttling being a primary source of cold to keep the plant in refrigeration balance. In view of the need to generate refrigeration through the throttling valve 16, the pressure on the upstream side of the valve 16 cannot normally be below a pressure in the order of 25 to 30 bar. This need to generate sufficient refrigeration by expansion of the feed gas through the throttling valve 16 effectively sets the lowest possible outlet pressure for the expansion turbine 6. Depending on its pressure, the feed gas stream is either liquefied in the main heat exchanger 10 or on expansion through the throttling valve 16. Typically, depending on its composition, at least 75 mole % of the feed gas stream is liquefied. In consequence, the vapour flow is reduced, thus making possible the use of a smaller diameter higher pressure rectification column than would otherwise be required. The vapour is disengaged from the liquid in the phase separator 18. A stream of the vapour phase flows from the top of the phase separator 18 through an inlet 26 into the bottom region of a higher pressure rectification column 22 forming part of a double rectification column 20 with a lower pressure rectification column 24 and a condenser-reboiler 25 thermally linking the top of the higher pressure rectification column 22 to the bottom of the lower pressure rectification column 24. A stream of the liquid phase flows from the bottom of the phase separator 18 into an intermediate mass exchange region of the higher pressure rectification column 22 through another inlet 30.

The feed gas mixture is separated in the higher pressure rectification column 22 into a vaporous nitrogen top fraction and a liquid methane-enriched bottom fraction. The nitrogen top fraction may contain an appreciable mole fraction of methane, particularly when the concentration of methane in the feed gas is at a maximum. A stream of the methane-enriched bottom fraction is withdrawn from the higher pressure rectification column 22 through a bottom outlet 32 and is sub-cooled by passage through a further heat exchanger 34. The resulting sub-cooled methane-enriched liquid stream flows through a throttling valve 36 and is introduced into an intermediate mass exchange region of the lower pressure rectification column 24. In addition, a liquid stream comprising methane and nitrogen is withdrawn from an intermediate mass exchange region of the higher pressure rectification column 22 through an outlet 38, is sub-cooled by passage through the further heat exchanger 34, is passed through a throttling valve 40 and is introduced into a second intermediate mass exchange region of the lower pressure rectification column 24 located above the first intermediate mass exchange region. Most of the refrigeration requirements of the process according to the invention may be met by the throttling valves 16, 36 and 40 and as a result there is typically no need to employ any turbo-expander for this purpose, although, as described below with reference to FIG. 3, a further expansion turbine operating at cryogenic temperatures may advantageously be employed in the method and apparatus according to the invention.

The streams passing through the valves 36 and 40 are separated in the lower pressure rectification column 24 in order to form a top nitrogen vapour fraction and a bottom product liquid methane fraction. This top nitrogen vapour fraction may contain an appreciable mole fraction of methane, particularly when the concentration of methane in the feed gas is at a maximum. A stream of the bottom fraction is withdrawn through an outlet 48 from the lower pressure rectification column 24 and is raised in pressure by operation of a pump 50. The resulting pressurised liquid methane stream is passed through the further heat exchanger 34 countercurrently to the streams being sub-cooled therein. The pressurisation of the product liquid methane stream has the effect of raising its pressure above its saturation pressure. Thus, in effect, the pressurised liquid methane product stream is in sub-cooled state as it enters the further heat exchanger 34. It is warmed in the further heat exchanger 34 to remove the sub-cooling. It is preferred that no vaporisation of the liquid methane product stream takes place in the further heat exchanger 34, although it may not prove possible on every occasion totally to avoid vaporisation of a small portion of the product stream. The warmed liquid methane product stream passes from the heat exchanger 34 through the main heat exchanger 10 from its cold end 14 to its warm end 12. It is vaporised as it passes through the main heat exchanger 10. The vaporised methane product is compressed to a desired product delivery pressure in a product compressor 66.

Reflux for the higher pressure rectification column 22 and the lower pressure rectification column 24 is formed by taking nitrogen vapour from the top of the higher pressure rectification column 22 and condensing it in the condensing passages of the condenser-reboiler 25. A part of the resulting condensate is returned to the higher pressure rectification column 22 as reflux. The remainder is sub-cooled by passage through the further heat exchanger 34 and is passed through a throttling valve 52 into the top of the lower pressure rectification column 24 and therefore provides liquid reflux for that column.

A nitrogen vapour stream (which may include methane impurity) is withdrawn from the top of the lower pressure rectification column 24 through an outlet 54 and is warmed by passage through the further heat exchanger 34. The resulting warmed nitrogen stream is further heated to approximately ambient temperature by passage through the main heat exchanger 10 from its cold end 14 to its warm end 12. The heated nitrogen flow passes from the main heat exchanger 10 to a pipeline 80. A part of the heated nitrogen flow may be employed in the regeneration of the adsorbent beds in the purification unit 2. The remainder of it may be vented.

In a typical example of the method according to the invention, the lower pressure rectification column 24 operates at a pressure in the order of 1.25 to 1.5 bar absolute at its top.

The method according to the invention is intended for operation over a prolonged period of time during which the mole fraction of methane in the feed gas will fall and the mole fraction of nitrogen in it will rise. It is contemplated that in the latter days of the plant's operation the mole fraction of methane will have decayed to about 0.4. As the mole fraction of methane declines, and hence the mole fraction of nitrogen increases, the condensation temperature of the feed gas falls. When the feed gas contains only 5% by volume of nitrogen and 95% by volume of methane it would be possible to liquid pump the methane product to 25 bar and vaporise it in indirect heat exchange with the incoming feed at a pressure of 40 bar. When the methane content of the feed gas is at a minimum, however, its dew point at the supply pressure of 40 bar allows the product stream to be pumped to just 9 bar. It is therefore feasible to operate the pump at a constant outlet pressure of 9 bar irrespective of the composition of the feed gas. When the feed gas stream is of a relatively high purity, the choice of an outlet pressure of 9 bar for the pump 50 allows the feed gas stream to be passed through the main heat exchanger at a pressure in the order of 18 bar. The method and apparatus according to the invention enable the difference between the initial pressure of the feed gas and the pressure at which it is passed through the main heat exchanger 10 to be exploited by expanding it from 40 bar to 18 bar in the expansion turbine 6, although for the reason explained above, a higher outlet pressure from the expansion turbine 6 in the order of bar may need to be employed.

After continuous operation for a prolonged period of time, the nitrogen content of the feed gas begins to rise and the methane content to fall. In order to maintain efficient heat exchange between the streams being warmed and that being cooled in the main heat exchanger 10, the pressure of the feed stream therethrough has to be increased commensurately and therefore the outlet pressure of the expansion turbine 6 has to be increased. Therefore less work is able to be recovered by the expansion of the feed gas stream. Eventually the nitrogen mole fraction of the feed gas becomes so large that the expansion turbine 6 can no longer be operated. The by-pass line 9 is then used to conduct all the feed gas directly to the main heat exchanger 10 without passing through the heater 4 and the expansion turbine 6. Typically, the product compressor 66 may be an integrally geared machine fitted with inlet guide vanes and diffuser guide vanes. These guide vanes may be adjusted automatically so as to compensate for a gradual decline in the product flow rate as the mole fraction of nitrogen in the feed gas increases.

Figure 2:
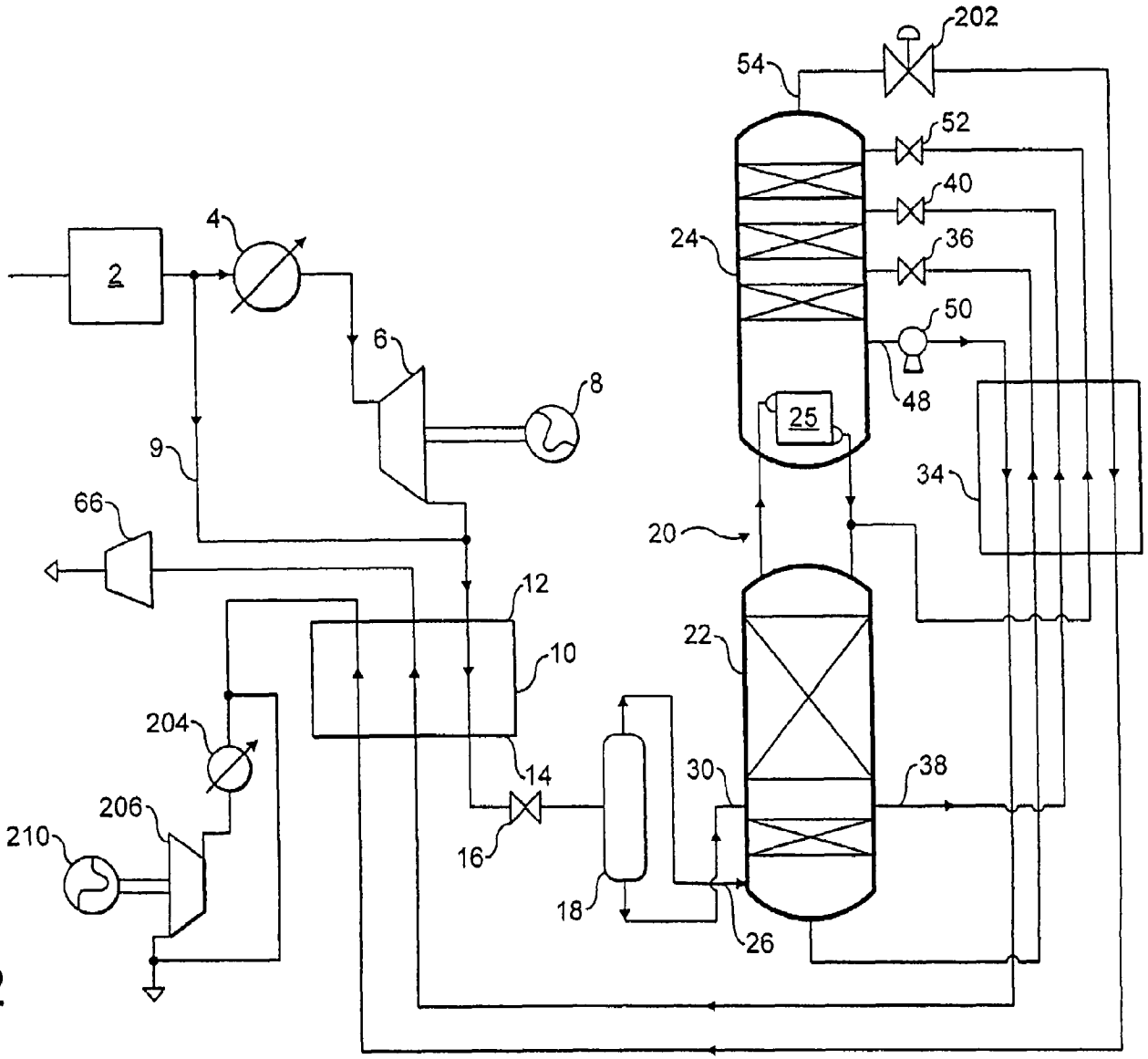
FIG. 2 is a schematic flow diagram of a second nitrogen rejection plant according to the invention.

Various expedients may be adopted in order to improve the operation of the plant shown in FIG. 1. One of these expedients is shown in FIG. 2 of the accompanying drawings. Referring to FIG. 2, the outlet 54 from the lower pressure rectification column 24 is provided with a back pressure regulator 202 which is operable so as to adjust the operating pressure of the lower pressure rectification column 24. In addition, there is provided in the pipeline 80 an additional heat exchanger 204 for raising the temperature of the nitrogen typically to a temperature in the range of 200° C. to 600° C. and, downstream of the additional heat exchanger 204, a further expansion turbine 206 which may be coupled to an alternator 208 and is therefore able to be employed in the generation of electrical power. A bypass pipe 210 is also provided to enable the nitrogen flow to bypass the heat exchanger 204 and the further expansion turbine 206. When the mole fraction of nitrogen in the feed gas has reached a level such that it is no longer desirable to operate the expansion turbine 6, the back pressure regulator 202 may be adjusted to raise the pressure in the lower pressure column 24 to a pressure in the range of approximately 2 bar to 2.75 bar and the resulting warmed nitrogen stream from the main heat exchanger 10 may be heated in the heat exchanger 204 and expanded with the performance of external work in the turbine 206, the nitrogen leaving the turbine 206 at approximately ambient pressure. The plant shown in FIG. 2 may thus be operated such that whatever the mole fraction of the nitrogen in the feed gas one or other of the expansion turbines 6 and 206 may be employed to generate electrical power. When the heat exchanger 204 and the expansion turbine 206 are not operated, the nitrogen may flow through the bypass pipe 210 so as to bypass these items of equipment.

Figure 3:
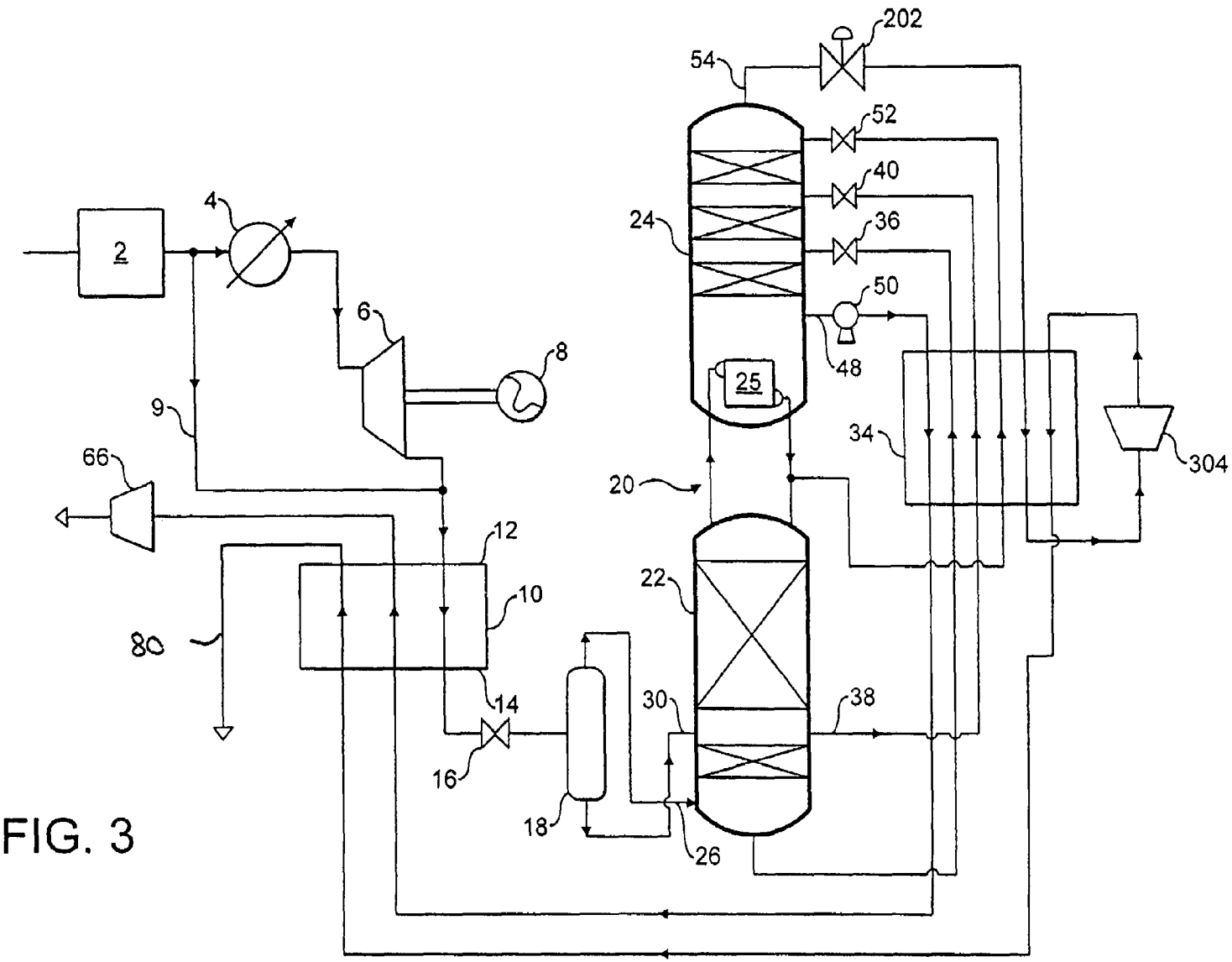
FIG. 3 is a schematic flow diagram of a third nitrogen rejection plant according to the invention.

In an alternative modification to the plant shown in FIG. 1, instead of employing the heat exchanger 204 and the expansion turbine 206, a cryogenic expansion turbine is employed instead. Such an arrangement is shown in FIG. 3 of the accompanying drawings. The plant shown in FIG. 3 has a cryogenic expansion turbine 304 which may be operated at higher nitrogen mole fractions in the feed gas. When the expansion turbine 304 is not operated, the nitrogen flowing out of the further heat exchanger 34 flows directly to the main heat exchanger 10. Generally, in this flow regime, the back pressure regulator 202 is set to maintain the top of the lower pressure rectification column at a pressure in the range of 1.25 to 1.5 bar. When the expansion turbine 304 is operated, however, the back pressure regulator 202 is set at a higher pressure and the nitrogen flows from the further heat exchanger 34 to the expansion turbine 304 and is expanded therein to a pressure in the order of 1.3 bar. The resulting expanded nitrogen is returned to the cold end of the heat exchanger 34 and flows all the way therethrough. The thus warmed and expanded nitrogen stream flows from the further heat exchanger 34 to the main heat exchanger 10. The operation of the expansion turbine 304 generates more refrigeration for the heat exchanger 34 and thereby leads to a greater degree of sub-cooling of the liquid streams passing therethrough from the higher pressure rectification column 22 to the lower pressure rectification column 24. As a result, additional reflux is provided for the lower pressure rectification column 24. The additional reflux has the effect of counteracting a tendency for an upper region of the lower pressure rectification column 24 to be "pinched" at higher nitrogen mole fractions in the feed gas and therefore leads to a greater recovery of methane product than would otherwise be obtained.

The method and apparatus according to the present invention will now be illustrated by the following Examples, fn all the Examples the feed gas pressure is 40 bar. Initially, the feed composition is 85% by volume of methane, 14.7% by volume of nitrogen, balance heavier hydrocarbons. Over a period of time the methane concentration falls to 60% by volume and the nitrogen concentration rises to 39.7% by volume. Further, the concentration of nitrogen in the methane product is always selected to be 0.5% by volume. It is to be understood that different methane product purities can be produced. For example, the nitrogen level in the product methane could advantageously be higher if a lower calorific value gas were acceptable.

EXAMPLE 1

Referring to FIG. 1, with the feed gas pressure of 40 bar, and with the initial feed gas composition as stated above, for operation of the heat exchanger 10 at optimum thermodynamic efficiency, the product gas pressure in the heat exchanger 10 should be in the order of 25.5 bar, whereas at the final feed composition, this product gas should be in the order of 13.9 bar. In this Example, however, the product gas pressure in the heat exchanger is kept constant at 13.9 bar. As a result the turbine 6 generates progressively less power.

For a feed gas flow of 10,000 $nm^3$/hr (normal cubic metres per hour), and a waste nitrogen gas pressure in the pipeline 80 of just above atmospheric pressure, the following results are achieved:

| | |
|---|---|
| Outlet pressure of expansion turbine 6 = | 26 bar |
| Power generated by expansion turbine 6 = | 112 kW |
| Product methane flow = | 7490 $nm^3$/hr |
| Methane recovery = | 92.5% |
| Waste nitrogen flow in pipeline 80 = | 2060 $nm^3$/hr |

As the methane content of the feed gas falls so the outlet pressure of the expansion turbine 6 rises until the following final conditions are reached, under which conditions the expansion turbine 6 is not operated.

| | |
|---|---|
| Product methane flow = | 6043 $nm^3$/hr |
| Methane recovery = | 99.7% |
| Waste nitrogen flow in pipeline 80 = | 3957 $nm^3$/hr |

The expansion turbine 6 enables the suction pressure of any upstream feed compressor to be modulated such that compression conditions do not alter significantly during the entire operating lifetime of the plant shown in FIG. 1. In addition, the turbine 6 enables power to be generated during a significant part of the operating lifetime of the plant Alternative operating strategies may be adopted. For example, the pressure of the product methane flow in the heat exchanger 10 could be adjusted such that suction volumes remain constant. If the feed flow to the plant remains constant, this would mean that the initial product methane pressure in the heat exchanger 10 would be adjusted to 18.2 bar, in which case the initial outlet pressure of the turbine would be 30.5 bar.

EXAMPLE 2

Referring to FIG. 2, operation of the expansion turbine 206 under the final operating conditions mentioned in FIG. 1 can generate additional power provided the operating pressure of the column 24 is raised. If the column 24 is operated at a pressure at its top of 2 bar, then the final operating conditions set out in Example 1 above are changed to:

| | |
|---|---|
| Product methane flow = | 6040.5 $nm^3$/hr |
| Methane recovery = | 99.67% |
| Waste nitrogen flow = | 3959.5 $nm^3$/hr |
| Power generated by expansion turbine 206 = | 68.4 kW |

EXAMPLE 3

Referring to FIG. 3, the expansion turbine 304 produces refrigeration and creates sufficient additional reflux for the column 24 to be operated at elevated pressure. Thus, the waste nitrogen in the pipeline 80 can be produced at elevated pressure enabling it to be expanded with the production of power by an expansion turbine (not shown) analogous to the expansion turbine 206 shown in FIG. 2. Under the initial operating conditions specified in Example 1 but with a pressure at the top of the column 24 of 2 bar, the following flows and power recovery are achieved.

| | |
|---|---|
| Product methane flow = | 7903 $nm^3/hr$ |
| Methane recovery = | 2097 $nm^3/hr$ |
| Waste nitrogen power generated = | 7.5 kW |

This power generation is in addition to the 112 kW generated by the expansion turbine 6 (see Example 1 above).

What is claimed is:

1. A method of rejecting nitrogen from a pressurised feed gas stream comprising methane and nitrogen so as to form a methane product, wherein the mole fraction of methane in said feed gas stream decreases during operation of said method comprising cooling the feed gas stream in a main heat exchanger, rectifying the cooled feed gas stream in a double rectification column comprising a higher pressure rectification column, a lower pressure rectification column, and a condenser/reboiler placing the higher pressure rectification column in heat exchange relationship with the lower pressure rectification column, withdrawing a product methane stream in liquid state from the lower pressure rectification column, raising the pressure of the liquid product methane stream, and vaporising the liquid product methane stream, at least part of the vaporisation being performed in the main heat exchanger, wherein over a range of feed gas stream pressures the pressurised feed gas stream is expanded to a chosen pressure with the performance of external work upstream of the main heat exchanger and the chosen pressure is increased with decreasing mole fraction of methane in the feed gas stream.

2. The method of claim 1, in which the external work performed by the expansion turbine is the generation of electrical power.

3. The method of claim 1, in which the pressure to which the liquid product methane stream is raised does not vary.

4. The method of claim 3, in which the operating pressure of the lower pressure rectification column is periodically increased in response to increases in the mole fraction of nitrogen in the pressurised feed gas stream.

5. A method of rejecting nitrogen from a pressurised feed gas stream comprising methane and nitrogen so as to form a methane product, wherein the mole fraction of methane in said feed gas stream decreases during operation of said method comprising cooling the feed gas stream in a main heat exchanger, rectifying the cooled feed gas stream in a double rectification column comprising a higher pressure rectification column, a lower pressure rectification column, and a condenser/reboiler placing the higher pressure rectification column in heat exchange relationship with the lower pressure rectification column, withdrawing a product methane stream in liquid state from the lower pressure rectification column, raising the pressure of the liquid product methane stream, and vaporising the liquid product methane stream, at least part of the vaporisation being performed in the main heat exchanger, wherein the operating pressure of the lower pressure rectification column is periodically increased in response to increases in the mole fraction of nitrogen in the pressurised feed gas stream, a stream of gas withdrawn from the lower pressure rectification column is expanded with the performance of external work, and over a range of feed gas stream pressures the pressurised feed gas stream is expanded to a chosen pressure with the performance of external work upstream of the main heat exchanger and the chosen pressure is increased with decreasing mole fraction of methane in the feed gas stream.

6. The method according to claim 5, in which the expansion of the said gas stream withdrawn from the lower pressure rectification column is performed downstream of the passage of said gas stream through the main heat exchanger.

7. The method according to claim 5, in which the expansion of the said gas stream withdrawn from the lower pressure rectification column is performed at cryogenic temperatures and is employed to generate refrigeration.

8. An apparatus for rejecting nitrogen from a pressurised feed gas stream comprising methane and nitrogen so as to form a methane product, comprising a main heat exchanger for cooling the feed gas stream, a double rectification column for rectifying the feed gas stream comprising a higher pressure rectification column, a lower pressure rectification column, and a condenser-reboiler placing the higher pressure rectification column in heat exchange relationship with the lower pressure rectification column, and a liquid pump for withdrawing and pressurising a stream of product methane in liquid state from the lower pressure rectification column and a back pressure regulating valve associated with the lower pressure rectification column which is operable to increase the pressure of the lower pressure rectification column, the liquid pump having an outlet communicating with vaporising passages in the main heat exchanger, wherein the apparatus additionally includes upstream of the main heat exchanger an expansion turbine operable over a range of feed gas pressures to expand the feed gas with the performance of external work.

9. The apparatus according to claim 8, additionally including a second expansion turbine for expanding a stream of gas withdrawn from the lower pressure rectification column, in which the second expansion turbine is in a position downstream of the passage through the main heat exchanger of said stream of gas withdrawn from the lower pressure rectification column.

10. The apparatus according to claim 8, additionally including a second expansion turbine for expanding a stream of gas withdrawn from the lower pressure rectification column, in which the second expansion turbine is arranged to operate at cryogenic temperatures.

* * * * *